US005316659A

United States Patent [19]

Brons et al.

[11] Patent Number: 5,316,659

[45] Date of Patent: May 31, 1994

[54] UPGRADING OF BITUMEN ASPHALTENES BY HOT WATER TREATMENT

[75] Inventors: Glen B. Brons, Phillipsburg; Michael Siskin, Morristown, both of N.J.; Kazimierz O. Wrzeszczynski, Media, Pa.

[73] Assignee: Exxon Research & Engineering Co., Florham Park, N.J.

[21] Appl. No.: 42,033

[22] Filed: Apr. 2, 1993

[51] Int. Cl.[5] ..... C10C 3/00; C10L 1/00

[52] U.S. Cl. ..... 208/39; 208/86; 208/390; 208/391; 44/623; 44/624

[58] Field of Search ..... 208/39, 86, 390, 391, 208/203; 44/623, 624

[56] References Cited

U.S. PATENT DOCUMENTS

| | | | |
|---|---|---|---|
| 3,305,474 | 2/1967 | Knowles et al. | 208/39 |
| 3,440,073 | 4/1969 | Fowler et al. | 106/280 |
| 3,676,331 | 7/1972 | Pitchford | 208/112 |
| 3,948,754 | 4/1976 | McCollum et al. | 208/11 LE |
| 3,948,755 | 4/1976 | McCollum et al. | 208/11 LE |
| 3,983,027 | 9/1976 | McCollum et al. | 208/8 |
| 3,983,028 | 9/1976 | McCollum et al. | 208/9 |
| 3,988,238 | 10/1976 | McCollum et al. | 208/9 |
| 4,036,732 | 7/1977 | Irani et al. | 208/390 |
| 4,057,484 | 11/1977 | Malek | 208/8 |
| 4,151,068 | 4/1979 | McCollum et al. | 208/11 LE |
| 4,557,820 | 12/1985 | Paspek, Jr. et al. | 208/8 LE |
| 4,559,127 | 12/1985 | Paspek, Jr. | 208/8 LE |
| 4,609,456 | 9/1986 | Deschamps et al. | 208/112 |
| 4,675,120 | 6/1987 | Martucci | 252/8.553 |
| 4,743,357 | 5/1988 | Patel et al. | 208/113 |

FOREIGN PATENT DOCUMENTS

| | | | |
|---|---|---|---|
| 1195639 | 10/1985 | Canada | 196/151 |
| 1275913 | 10/1986 | Canada | 166/35 |

OTHER PUBLICATIONS

Shaw, J. E., Molecular weight reduction of petroleum asphaltenes by reaction with methyl iodide-sodium iodide, vol. 68, pp. 1218-1220 (1989).

Berkowitz, N. and J. Calderon, Extraction of Oil Sand Bitumens with Super-critical Water, Fuel Processing Technology, vol. 25, pp. 33-44 (1990).

*Primary Examiner*—R. Bruce Breneman
*Assistant Examiner*—Patricia L. Hailey
*Attorney, Agent, or Firm*—James H. Takemoto

[57] ABSTRACT

A process for upgrading bitumen asphaltenes obtained from tar sands to hydrocarbons which comprises contacting the bitumen with a deasphalting solvent to yield a deasphalted oil and a residual solid asphaltene, separating the residual solid asphaltene from the deasphalted oil and treating the solid asphaltene fraction with superheated water at temperatures of from 300° to 425° C.

5 Claims, 6 Drawing Sheets

UPGRADING OF BITUMEN ASPHALTENES BY HOT WATER TREATMENT

BACKGROUND OF THE INVENTION

1. Field of the Invention

This invention relates to the treatment and upgrading of bitumen asphaltenes from oil sands. More particularly, whole bitumen recovered from tar sands is deasphalted and the asphaltene portion treated with superheated water.

2. Description of the Related Art

Conventional processing of tar sands involves separating whole bitumen from the oil-bearing sand by treatment with hot water, steam or some combination thereof. The separated whole bitumen is highly viscous and can be transferred by pipeline only if the viscosity is reduced, e.g., as by the addition of a diluent solvent. Whole bitumen can be further processed and upgraded, e.g., fractionation by thermal treatment to remove lighter ends or extraction with a deasphalting solvent to yield a deasphalted oil and an asphaltene precipitate. Either method results in substantial amounts of heavy resid or asphaltene residue which on further processing form coke-like material which cannot be economically converted to useful products and therefore presents disposal problems.

Extraction of tar sands and removal of organics from oil shales has also been accomplished using "supercritical water", i.e., water that is maintained at temperatures above its critical temperature. Since the critical temperature of a material is that temperature above which it cannot be liquified no matter how much pressure is applied, "supercritical water" is a dense fluid. Supercritical fluids are known to possess unusual solvent properties, and their application to separation of organic matter from oil shale and tar sands in the presence of a sulfur-resistant catalyst results in recovered hydrocarbon.

In another approach, whole bitumen treated with "supercritical water" in the presence of CO results in less coke produced via the thermal decomposition route at such elevated temperatures.

At temperatures near or above the critical temperatures, tar sands and whole extracted bitumen undergo undesirable thermal reactions leading to coke formation. Conventional processing of whole bitumen by vacuum distillation or solvent extraction results in a lighter fraction which can be further processed and a significant amount of heavy, solid asphaltene which cannot be economically converted to lighter fractions and thus presents disposal problems as well as loss of potentially valuable hydrocarbon material.

SUMMARY OF THE INVENTION

The present invention provides a process for recovering hydrocarbons from solvent precipitated asphaltenes. More particularly, the process of the invention for producing hydrocarbons from recovered bitumen from tar sands or petroleum hydrocarbons comprises contacting the bitumen with a deasphalting solvent to yield a deasphalted oil and a residual solid asphaltene, separating the residual solid asphaltene fraction from the deasphalted oil, and treating the solid asphaltene fraction with superheated water at temperatures of from 300° to 425° C. The resulting water-treated asphaltenes are thermally converted to hydrocarbon liquids with significantly lower fixed carbon residue and solids that show no increase in fixed carbon residue.

DESCRIPTION OF THE PREFERRED EMBODIMENTS

Figure 1:
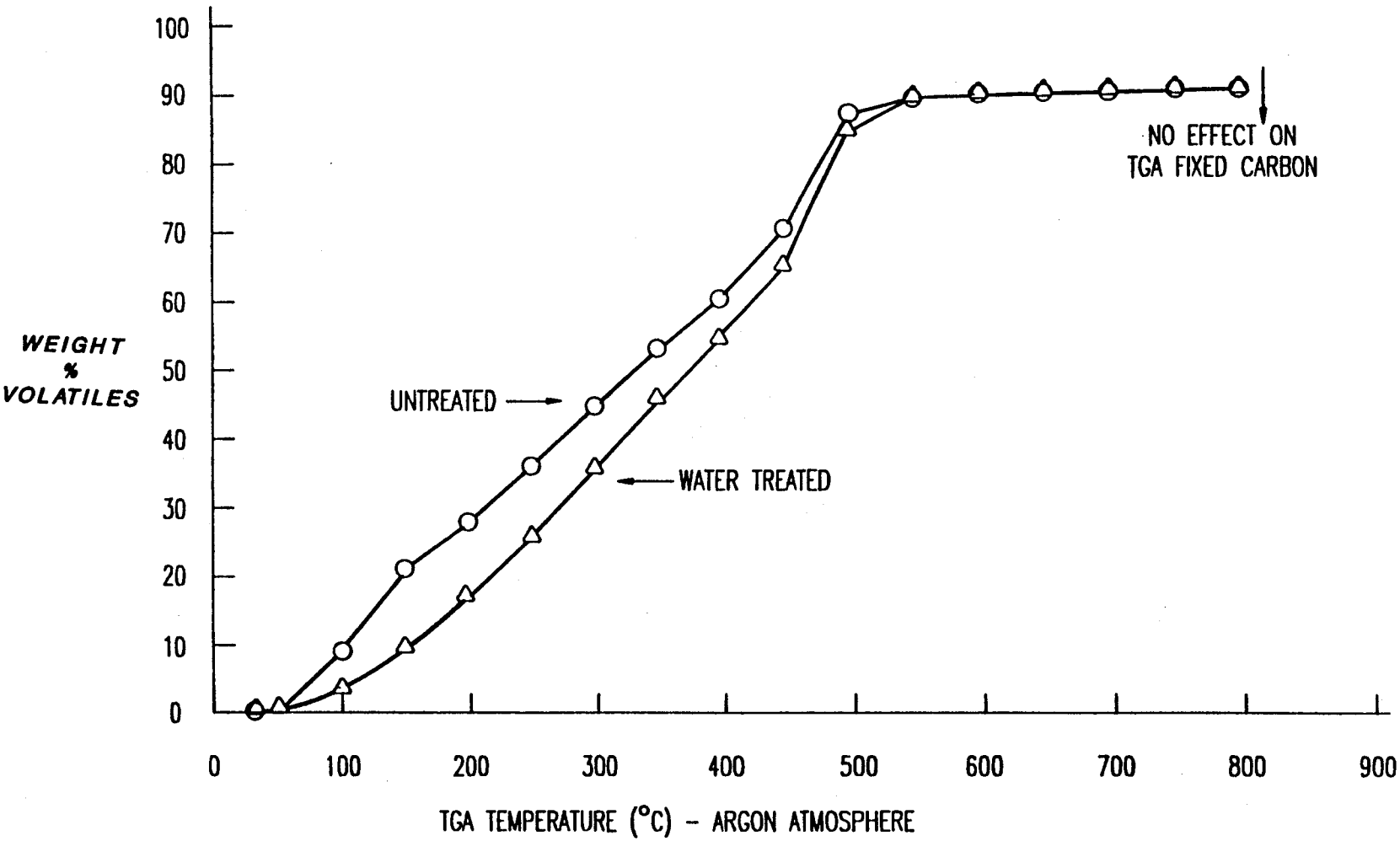
FIG. 1 is a thermal gravimetric analysis thermogram of water-only treated whole bitumen.

Solvent deasphalting of whole bitumen can be accomplished using a deasphalting solvent, preferably a $C_3$–$C_5$ aliphatic hydrocarbon solvent. Especially preferred deasphalting solvents are propane and butane. Preferred solvent to whole bitumen treat ratios are from about 4:1 to about 20:1. The precipitated asphaltenes vary from about 20 to 50% of the whole bitumen depending on the nature of the bitumen itself and the solvent employed. These asphaltenes have an increased average molecular weight over whole bitumen and also show increased heavy metal and sulfur concentrations. The deasphalted oil phase can be separated from the precipitated asphaltene phase using separation techniques well known in the art.

In accordance with the present invention, it has been discovered that the precipitated asphaltene fraction can be treated with superheated water at temperatures of from about 300° to about 425° C., preferably 350° to 400° C. The water-treated asphaltenes obtained show lower average molecular weight, no increase in fixed carbon levels, and heteroatom removal.

It has been discovered that precipitated asphaltenes obtained from the deasphalting process behave differently from either the whole bitumen or the deasphalted oil fraction upon water treatment according to this invention. Neither the whole bitumen nor the deasphalted oil fraction show any decrease in average molecular weight which would be indicative of disruption of the macromolecular structure of asphaltenes.

At temperatures below about 300° C., little or no effect is observed on the average molecular weight. At temperatures above 374° C., which is the critical temperature of water, undesirable thermal damage is observed in whole bitumen which has not been solvent deasphalted according to the present process. This leads to the generation of heavier materials and therefore reduced yields of desirable hydrocarbons upon conventional upgrading. Thermal treatment of whole bitumen, deasphalted oil and precipitated asphaltenes in the absence of water over the temperature range 315° to 400° C. does not show the improvements over the water treatment process of the invention. As noted previously, thermal treatment at temperatures exceeding the critical temperature of water (in the absence of water) leads to increased thermal degradation as reflected in the heavier-end materials produced. Moreover, the hydrogen to carbon ratio decreases while the micro Conradson carbon residue values increase at temperatures above the critical temperature thus providing further evidence of degradation.

The nature of the hydrocarbon solvent used to deasphalt the tar sands impacts the quality of the deasphalted oil fraction and the residual asphaltene fraction. In general, the lighter the hydrocarbon solvent used to deasphalt the bitumen, the lighter the deasphalted oil and the lower the yield. From a processing standpoint, lighter deasphalted oil is easier to handle. However, low yields are undesirable from an economic standpoint as the asphaltene fraction is a less useful product.

The process of this invention converts the residual asphaltene fraction to a product which can be upgraded in high yields to useful product. It is important that the bitumen be first deasphalted, then treat the asphaltenes with superheated water according to the invention. This provides the maximum benefit in terms of total recoverable product vs. deasphalting alone or thermal treatment of whole bitumen.

After separation from the deasphalted oil fraction, the residual asphaltene fraction is treated with superheated water. The residual asphaltene fraction is charged into a pressure reactor in the presence of excess water, sealed under inert atmosphere and heated to the desired temperature. The amount of water is not critical provided that an excess amount is employed (>2:1 water:asphaltene). Similarly, the time is that sufficient to convert asphaltenes to lighter products. Prolonged heating may lead to thermal degradation. This degradation effect can be monitored by checking fixed carbon as a function of time. Generally, times of from about 1 to 3 hours are suitable.

A product obtained from treating residual asphaltene fractions with superheated water is an oil-like fraction indicating that the macromolecular structure of asphaltenes has been broken down into smaller units. These oil fractions contain mostly $C_3$–$C_{23}$ paraffins and can be upgraded using conventional distillation techniques.

The present invention is further illustrated by the following examples, which also illustrate a preferred embodiment.

EXAMPLE 1

The effect of solvent used to deasphalt a whole bitumen is illustrated in this example. Whole Cold Lake (Canada) bitumen is treated with a propane (8:1), butane (8:1) or pentane (20:1) solvent. Precipitated asphaltenes are separated from the deasphalted oil solvent phase and dried. Analyses of the respective asphaltenes are given in Table 1.

TABLE 1

| Weight % | n-C5 | n-C4 | $C_3$ |
|---|---|---|---|
| Water (KF, 200° C.) | 0.21 | 0.034 | <0.04 |
| 200° C. Weight Loss | 0.32 | 1.48 | 3.14 |
| Lights (200° C.) | 0.11 | 1.45 | 3.14 |
| Ash | 0.59 | 0.44 | <0.24 |
| Wt. % (DAF basis)[1] | | | |
| Carbon | 81.03 | 81.35 | 81.80 |
| Hydrogen | 8.02 | 7.88 | 9.38 |
| Nitrogen | 1.09 | 1.40 | 0.53 |
| Sulfur | 8.17 | 7.44 | 6.87 |
| Oxygen (diff) | 1.69 | 1.93 | 1.42 |
| Atomic Ratios | | | |
| H/C | 1.187 | 1.162 | 1.376 |
| N/C | 0.012 | 0.015 | 0.006 |
| S/C | 0.038 | 0.034 | 0.031 |

TABLE 1-continued

| Weight % | n-C5 | n-C4 | $C_3$ |
|---|---|---|---|
| O/C | 0.016 | 0.018 | 0.013 |
| Wt. % MCR[2] (DAF) | 44.70 | 35.25 | 25.41 |
| Wt. % TGA[3] Fixed Carbon | 38.0 | 28.9 | 28.0 |
| Wt. % Vanadium | 0.0645 | 0.048 | 0.0423 |
| Wt. % Nickel | 0.0242 | 0.019 | 0.0173 |
| MW (VPO, toluene, 60° C.)[4] | 5472<br>5461 | 1461 | 1103 |

[1]DAF = dry, ash free
[2]MCR = microcarbon residue
[3]TGA = thermogravimetric analysis
[4]VPO = vapor pressure osmometry The asphaltenes precipitated from n-pentane represents 20.5 wt. % of the whole bitumen whereas that from n-butane and propane represent 28.4 and 47.8 wt %, respectively. The deeper cut made by the n-pentane results in a material even more concentrated in heavier-end fractions than that with n-butane or propane. Analysis of each sample supports this (Table 1) in that while the n-pentane and n-butane samples have similar H/C ratios, the n-pentane asphaltene is much higher in average molecular weight, MCR, and TGA fixed carbon (TGA fixed carbon is that referred to as heavy-end material that does not volatilize under an inert atmosphere even when heated up to 800° C. Only in the presence of oxygen will this type of material burn off). In addition, the n-pentane asphaltene contains higher concentrations of sulfur and heavy metals (Ni, V). The propane precipitated asphaltene represents more of the whole bitumen and therefore the observed differences between the asphaltenes are expected. These differences, however, are primarily due to concentration effects.

EXAMPLE 2

This example shows the effect of superheated water treatment on a whole bitumen and on its deasphalted oil portion. Whole Cold Lake bitumen was deasphalted using n-butane at a 4:1 treat ratio. The n-butane soluble portion, i.e., the maltene fraction and the whole Cold Lake bitumen itself were heated in a stainless steel (T316 grade) sealed mini-reactor at 350° C. for 2 hours in the presence of water at a 6:1 treat ratio. After cooling, the contents of the reactor were analyzed for %C, H, N, S and average molecular weight by vapor pressure osmometry. The results are shown in Table 2 (whole bitumen) and Table 3 (maltene fraction).

TABLE 2

| Weight % | Untreated | Thermal | Water |
|---|---|---|---|
| Carbon | 83.71 | 83.84 | 83.88 |
| Hydrogen | 10.44 | 10.34 | 10.49 |
| Nitrogen | 0.75 | <0.5 | <0.5 |
| Sulfur | 4.93 | 4.74 | 4.64 |
| Oxygen (diff) | 0.17 | 0.51 | 0.49 |
| Atomic Ratio | | | |
| H/C | 1.497 | 1.480 | 1.501 |
| N/C | 0.008 | <0.005 | <0.005 |
| S/C | 0.022 | 0.021 | 0.021 |
| Avg. MW (VPO) | 481 | 493 | 500 |

TABLE 3

| Weight % | Untreated | Thermal | Water |
|---|---|---|---|
| Carbon | 84.67 | 85.85 | 84.67 |
| Hydrogen | 10.99 | 11.20 | 11.04 |
| Nitrogen | 0.73 | <0.5 | <0.5 |
| Sulfur | 3.56 | 3.65 | 3.65 |
| Oxygen (diff) | 0.05 | 0.00 | 0.14 |

TABLE 3-continued

| Weight % | Untreated | Thermal | Water |
|---|---|---|---|
| Atomic Ratio | | | |
| H/C | 1.558 | 1.566 | 1.565 |
| N/C | 0.007 | <0.005 | <0.005 |
| S/C | 0.016 | 0.016 | 0.016 |
| Avg. MW (VPO) | 406 | 402 | 407 |

Tables 2 and 3 demonstrate that superheated water treatment on whole bitumen and deasphalted oil has minimal impact as reflected in the neglible changes in H/C ratios and negligible impact on average molecular weight.

Figure 2:
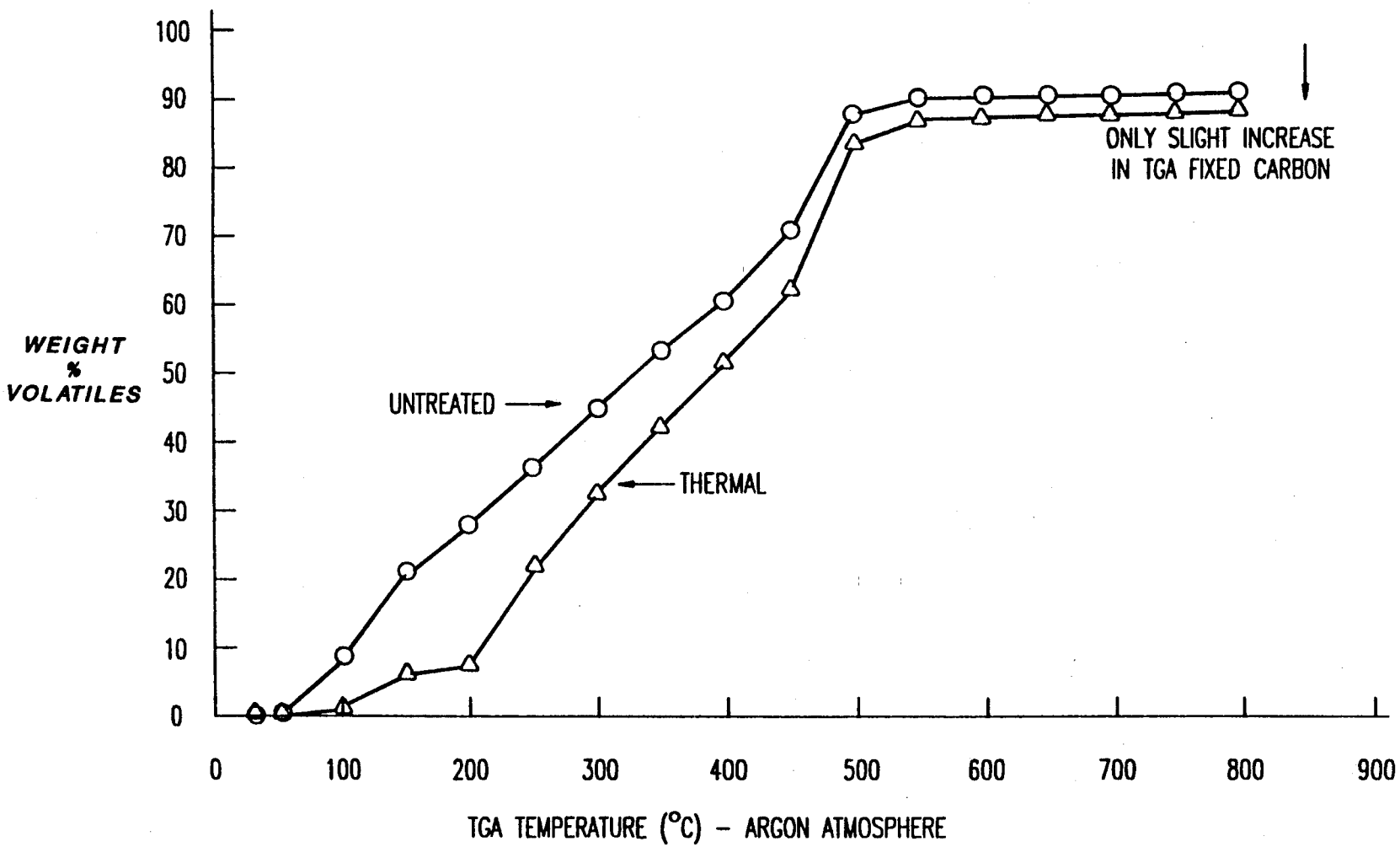
FIG. 2 is a thermal gravimetric analysis thermogram of thermal-only treated whole bitumen.

These results are further confirmed by thermal gravimetric analyses (TGA) data as shown in FIGS. 1 and 2. FIG. 1 is a TGA thermogram of Cold Lake whole bitumen which has been water-only treated at 350° C. for 2 hours. FIG. 2 is a TGA thermogram of Cold Lake whole bitumen which has been thermal-only treated at 350° C. for 2 hours. Both FIGS. 1 and 2 demonstrate that either water-only or thermal-only on whole bitumen have little or no effect on TGA fixed carbon.

EXAMPLE 3

The generation of heavier-end product by a comparative thermal-only treatment of $C_4$ and $C_5$ precipitated asphaltenes is shown in this example. Precipitated asphaltenes prepared according to Example 1 are thermally treated for 2.0 hours at 350° C. or 400° C. Table 4 shows the comparison between a thermally untreated $C_4$ or $C_5$ asphaltene vs. thermally treated $C_4$ or $C_5$ asphaltene with the results of a thermal gravimetric analysis ("TGA")

TABLE 4

| | $C_5$ Asphaltenes | | $C_4$ Asphaltenes | | |
|---|---|---|---|---|---|
| Wt. % (As Rec'd) | Untreated | 350° C. | Untreated | 350° C. | 400° C. |
| Lights (200° C.) | 0.11 | — | 1.45 | 5.94 | 16.83 |
| Ash | 0.59 | 0.84 | 0.44 | 0.50 | 0.76 |
| Wt. % (DAF Basis) | | | | | |
| Carbon | 81.03 | 81.69 | 81.35 | 82.71 | 84.95 |
| Hydrogen | 8.02 | 8.00 | 7.88 | 8.67 | 6.58 |
| Nitrogen | 1.09 | 0.66 | 1.40 | 0.79 | 1.16 |
| Sulfur | 8.17 | 8.75 | 7.44 | 7.37 | 6.98 |
| Oxygen (diff) | 1.69 | 0.90 | 1.93 | 0.46 | 0.33 |
| Atomic Ratios | | | | | |
| H/C | 1.187 | 1.175 | 1.162 | 1.215 | 0.929 |
| N/C | 0.012 | 0.007 | 0.015 | 0.008 | 0.012 |
| S/C | 0.038 | 0.040 | 0.034 | 0.033 | 0.031 |
| O/C | 0.016 | 0.008 | 0.018 | 0.004 | 0.003 |
| Wt. % MCR (DAF) | 44.70 | 44.80 | 35.25 | 41.56 | 63.35 |
| Wt. % TGA FC[1] | 38.0 | 40.0 | 28.9 | 33.2 | 49.2 |

[1]TGA FC = fixed carbon.

Figure 3:
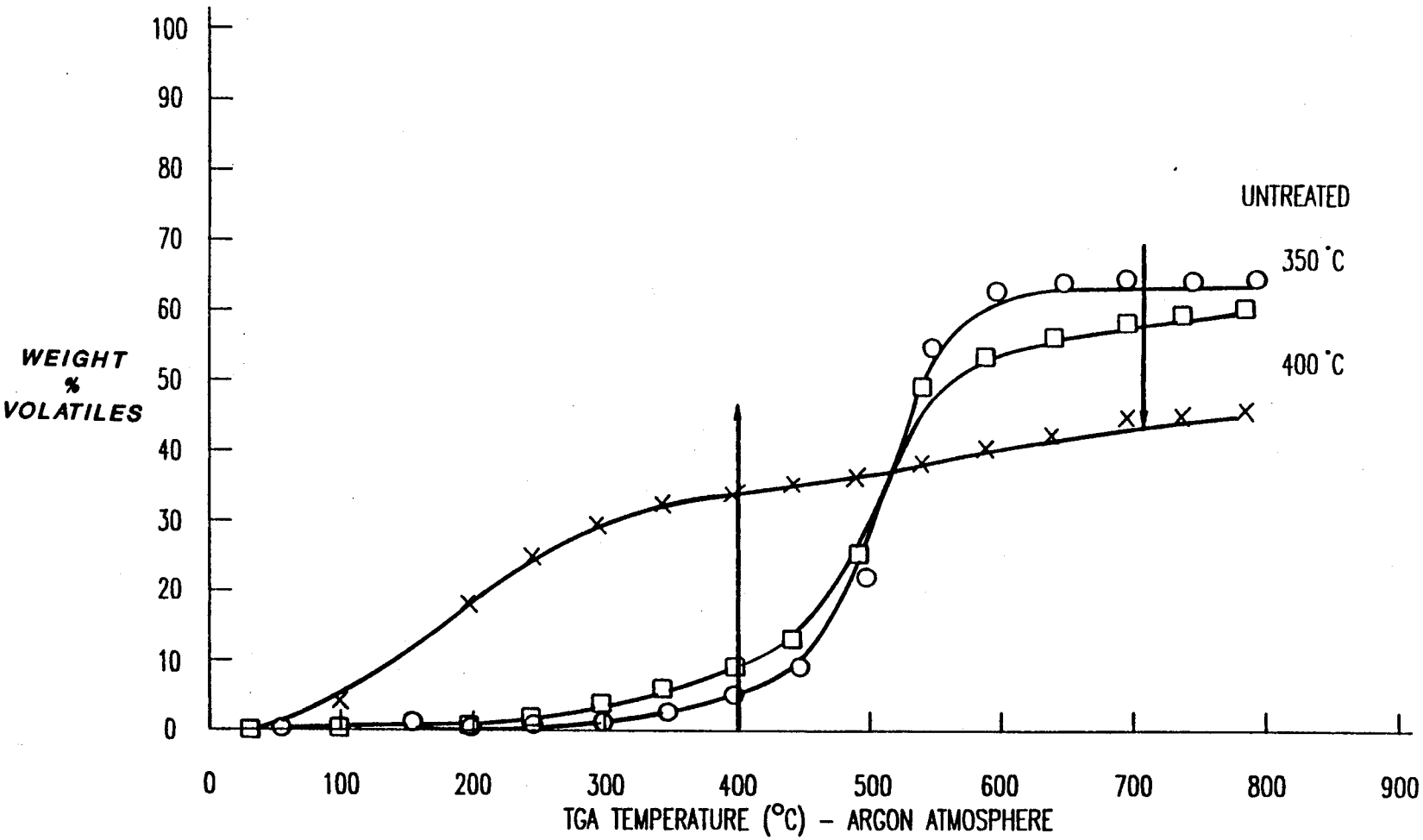
FIG. 3 is a thermal gravimetric analysis thermogram of thermal-only treated n-butane extracted bitumen asphaltenes.

As can be seen, there are slight increases in fixed carbon levels in both samples after treatment at 350° C. This effect is even more pronounced when treated at 400° C., where the $C_4$ asphaltene fixed carbon increased from 28.9 to 49.2 wt. %. TGA data also shows that lighter-end materials are generated as well, the degree of which is also a function of temperature (FIG. 3). This shows that these asphaltenes do start to break down thermally. However, as illustrated, this light-end production is at the expense of forming much heavier-end material than that of the original asphaltenes.

As also shown in Table 4, further evidence of the 'damage' by thermal-only treatments lies in the reduction in the sample's total H/C atomic ratio (Table 2). At 400° C., the H/C of the $C_4$ asphaltenes decreases from 1.16 to 0.93, which is accompanied by only slight reductions in sulfur (S/C: 0.034 to 0.031). In addition, MCR values increase from 35.25 to 63.35 wt. % after the 400° C. treatment of $C_4$ asphaltenes. MCR is a measure of that which remains after controlled heating at 550° C. for a period of 20 minutes. While MCR shows the same trend as that observed by TGA, it should be noted that MCR reports only a weight percent value and gives no information about the nature of the material. By example, as illustrated here, the thermal treatment at 400° C. increases the MCR to 63.35 wt. %. Only by TGA does one observe that the non-residue portion is actually much lighter material than that of the non-residue untreated material (FIG. 3). Also, the material above the MCR's 550° C. limit, is more heavier-end type material as observed by the TGA fixed carbon increases.

Average molecular weight determinations by VPO were not possible for these thermal-only treated samples. VPO measurements are carried out in toluene at 60° C. and depend on complete sample solubility. With heavier-end materials generated, these samples were not completely soluble and therefore measurements were not possible.

EXAMPLE 4

This example illustrates the superheated water treatment according to the invention and the effect of temperature on the conversion of separated asphaltenes and untreated asphaltenes. Cold Lake whole bitumen is extracted with n-butane at a 6:1 solvent to bitumen ratio and with n-pentane at a 20:1 solvent to bitumen ratio. Deasphalted oil is separated from the solid asphaltene residual fraction. The separated asphaltenes are then heated with water at a 12:1 water to asphaltene ratio at temperatures of 350° C. and 400° C. for 2 hours.

Figure 4:
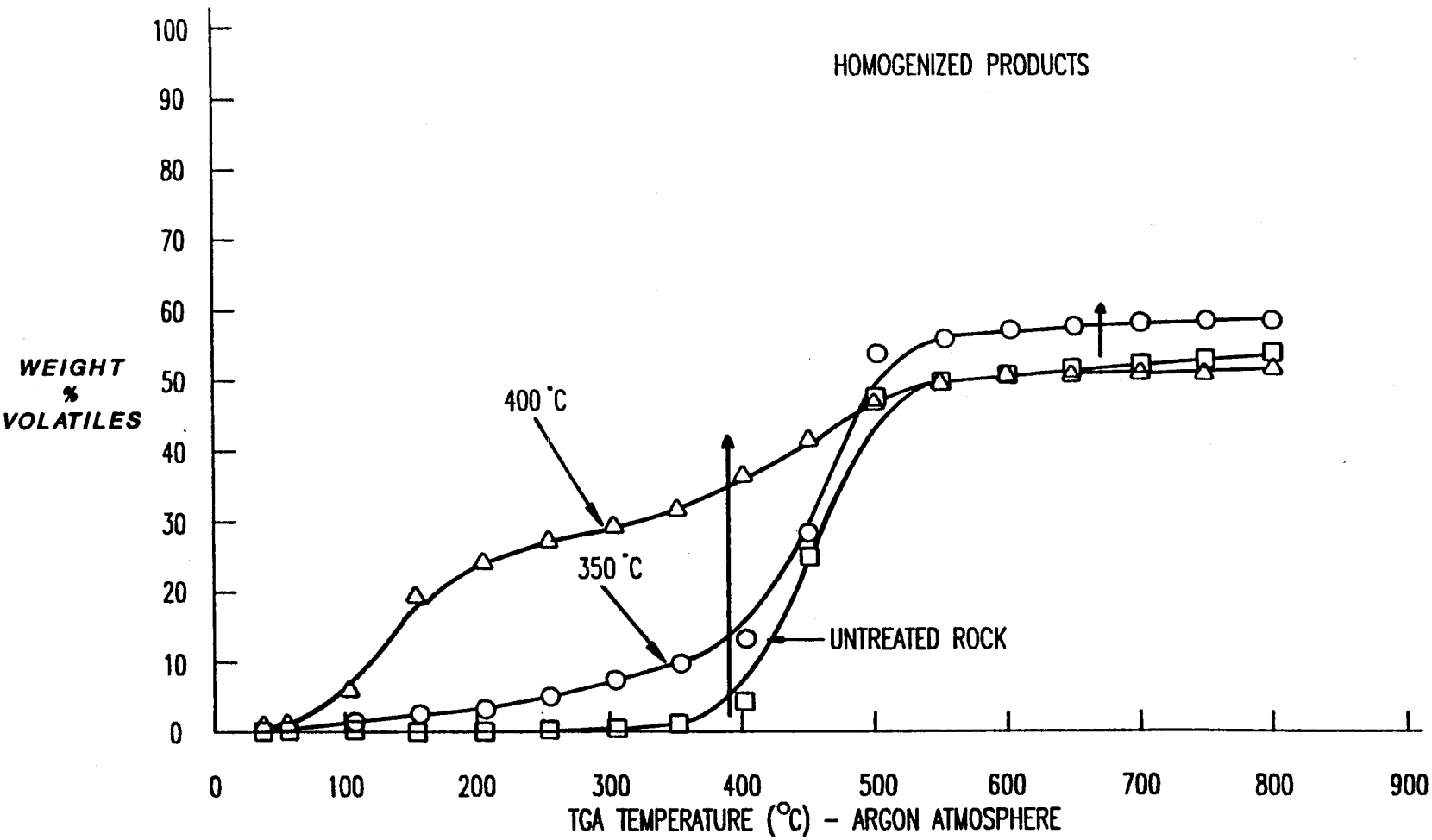
FIG. 4 is a thermal gravimetric analysis thermogram of water-only treated pentane extracted bitumen asphaltenes.
Figure 5:
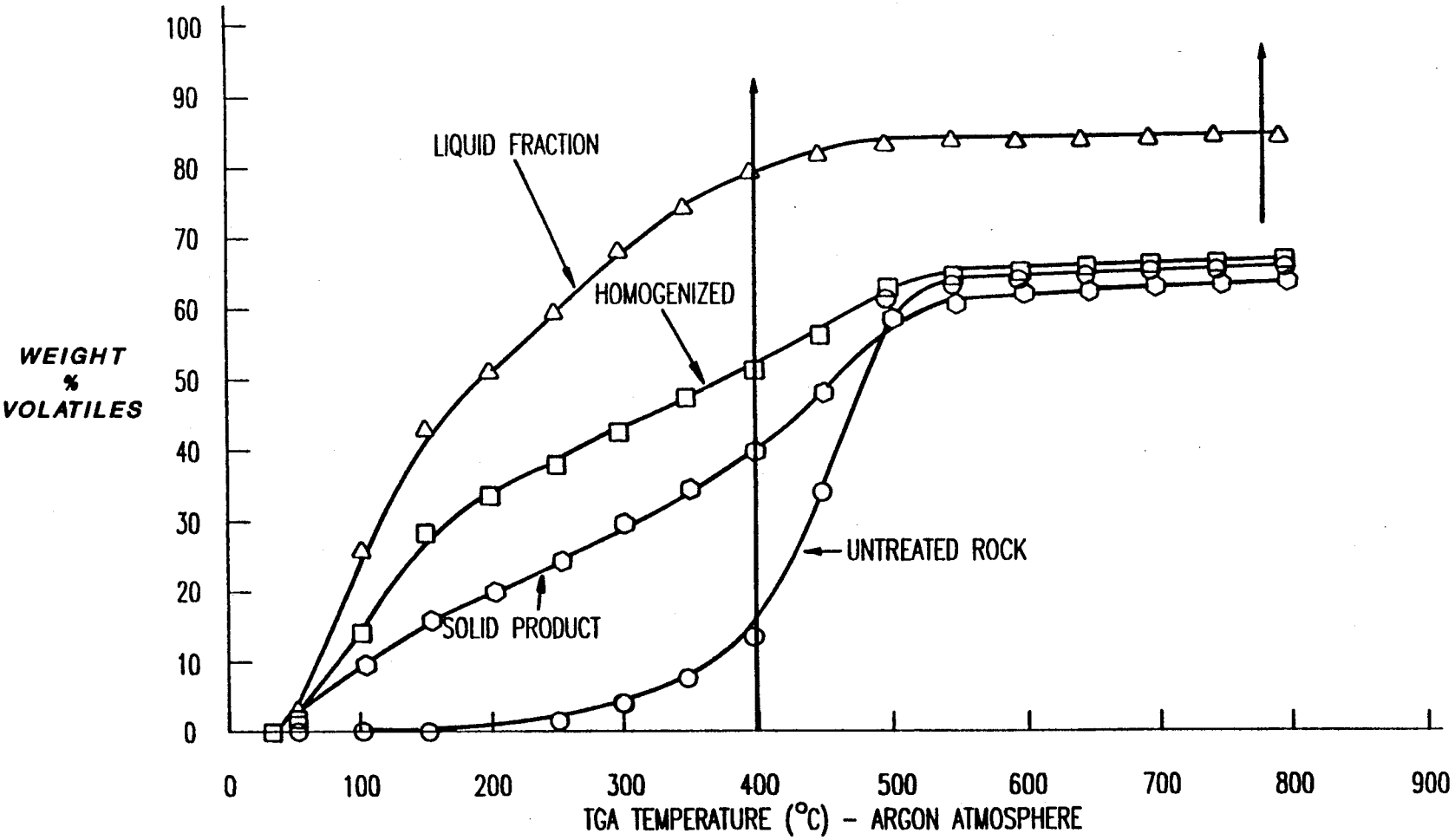
FIG. 5 is a thermal gravimetric analysis thermogram of water-only treated propane extracted bitumen asphaltenes.

Upon completion of the superheated water treatment, the initially solid "rock-like" asphaltenes are converted to both solid and liquid products which are easily separated. This is unlike thermal-only treatment which results in a single sticky solid. TGA analysis may be performed on the separated liquid and solid products or as a single homogenized product. FIG. 4 illustrates a TGA analysis of homogenized products from pentane precipitated asphaltenes subjected to water-only treatment according to the invention for 2 hours at 350° and 400° C. FIG. 5 shows the results of a TGA analysis of both homogenized and separated products from propane precipitated asphaltenes subjected to a water-only treatment for 2 hours at 400° C.

As shown in FIGS. 4 and 5, superheated water treatment on separated asphaltenes results in increased yields of liquid products based on a TGA analysis as compared to untreated asphaltenes, i.e., asphaltenes which are not treated with superheated water according to the subject invention. The TGA analyses also demonstrate that at a temperature of about 400° C., the yield of light end products is higher in the liquid and solid product as compared to the untreated asphaltenes.

FIGS. 4 and 5 also show that increasing temperatures above the critical temperature of water results in increased yields of light products without damaging thermal effects provided that the separation according the invention has occurred.

EXAMPLE 5

This example compares effects of superheated water treatment versus thermal-only treatment. Whole Cold Lake bitumen is treated with n-butane at a solvent to bitumen ratio of 8:1. The precipitated solid asphaltenes are separated. One sample of separated residual asphaltene is treated with superheated water at 400° C. for 2 hours. The resulting liquid and solid products are homogenized into a single product. Another sample is subjected to thermal treatment at 400° C. without water. The homogenized product and the thermal only product are then subjected to TGA.

Figure 6:
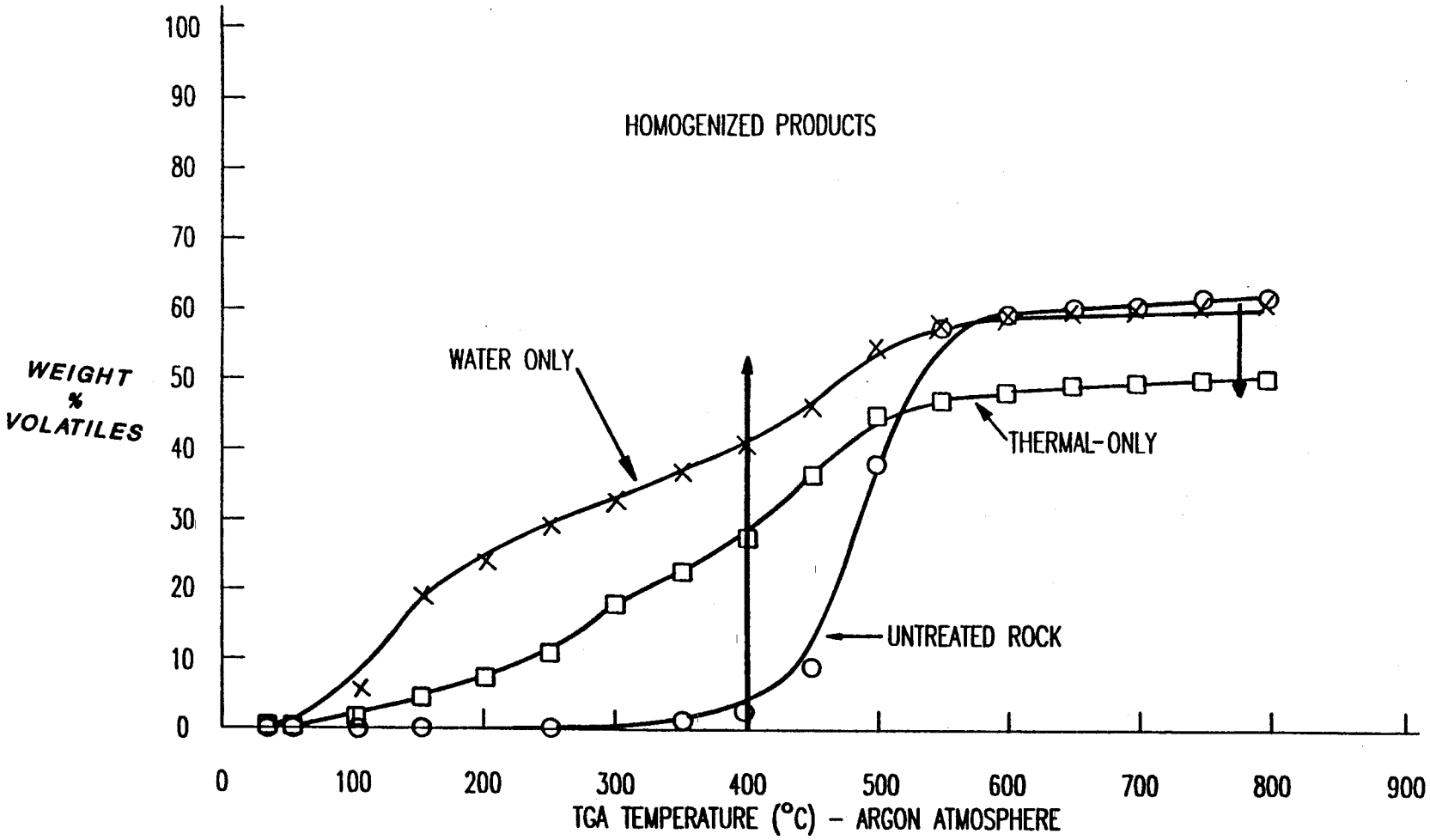
FIG. 6 is a comparative thermal gravimetric analysis thermogram of water-only vs. thermal-only treated n-butane extracted bitumen asphaltenes.

The results are shown in FIG. 6 which is a TGA analysis of water-only vs. thermal-only treatments at 400° C. for 2 hours of n-butane precipitated asphaltenes. This figure shows that superheated water treatment results in higher yields of light products as compared to thermally treated asphaltenes or untreated asphaltenes. Moreover, analysis for fixed carbon reveals that thermal-only treatment results in higher fixed carbon levels.

What is claimed is:

1. A process for producing hydrocarbons from recovered bitumen from tar sands or petroleum hydrocarbons which comprises mixing the bitumen with a deasphalting solvent to yield a deasphalted oil and a residual solid asphaltene, separating the residual solid asphaltene from the deasphalted oil, and heating the solid asphaltene fraction with superheated water at temperatures of from 300° to 425° C.

2. The process of claim 1 wherein the temperature is from 350° to 400° C.

3. The process of claim 1 wherein the deasphalting solvent is a $C_3$ to $C_5$ aliphatic hydrocarbon solvent.

4. The process of claim 1 wherein the solvent to bitumen ratio is from about 4:1 to about 20:1 by weight.

5. The process of claim 3 wherein the solvent is propane or butane.

* * * * *